United States Patent [19]

Bolen

[11] 4,331,340

[45] May 25, 1982

[54] WATER AND SNOW PLANING BOARD

[76] Inventor: Robert D. Bolen, 1818 Pine St., Huntington Beach, Calif. 92648

[21] Appl. No.: 156,355

[22] Filed: Jun. 4, 1980

[51] Int. Cl.[3] ..... A63C 15/00

[52] U.S. Cl. ..... 280/12 R; D21/228; 280/28; 441/65

[58] Field of Search ..... 280/12 R, 18, 19, 12 B, 280/610, 28; 9/310 E, 310 B, 310 G, 310 F; D21/228, 229

[56] References Cited

U.S. PATENT DOCUMENTS

| | | | |
|---|---|---|---|
| D. 221,697 | 8/1971 | Nicholson | D21/228 |
| 821,806 | 5/1906 | Johnston | 9/310 E |
| 2,961,362 | 11/1960 | Landes | 280/610 |
| 3,042,945 | 7/1962 | Saeman | 9/310 B |
| 3,384,910 | 5/1968 | Heston | 9/310 B |
| 3,481,619 | 12/1969 | Powers | 280/12 R |

*Primary Examiner*—David M. Mitchell

*Attorney, Agent, or Firm*—Knobbe, Martens, Olson, Hubbard & Bear

[57] ABSTRACT

A water or snow planing board, such as a surfboard, ski or toboggan, formed of two sheets of polymeric resin, which may be glass fiber reenforced, bonded together in co-mating peripheral lip portions to form a flat joining flange extending laterally outwardly around the periphery of the planing board, the bottom of the flange being co-planar laterally with the bottom of the planing board, and means for selectively controlling the buoyancy and weight of the planing board by admitting or expelling liquid therefrom is disclosed.

4 Claims, 5 Drawing Figures

WATER AND SNOW PLANING BOARD

TECHNICAL FIELD

The present invention relates to planing boards which may be used, most generally, as water planing boards, e.g. water skiis, surfboards, and the like, or as snow planing boards, e.g. as toboggans or sleds. More particularly, the present invention relates to an improved planing board characterized in that it is so constructed as to form an outwardly extending flange which laterally is co-planar with the bottom of the board.

Numerous designs and constructions for water planing boards, e.g. surfboards, knee boards, water skiis, and the like have been proposed. In all instances, of which I am aware, the bottom or planing surface of the board is so constructed and configured as to curve gently up, laterally, so that the sides of the planing surfaces are enveloped in one degree or another in the water. It has been thought that such an approach reduced the frictional resistance of the water to movement of the board. Water craft generally include this configuration. See, for example, Christensen, U.S. Pat. No. 3,553,750; Kenmuir, U.S. Pat. No. 3,380,090; Halfon, U.S. Pat. No. 3,956,785; Love, U.S. Pat. No. 2,998,798; Krupnik, U.S. Pat. No. 3,143,357; Greig et al, U.S. Pat. No. 3,383,720; Stefani, U.S. Pat. No. 2,950,701; Sawchuk, U.S. Pat. No. 3,213,822; Bombardier et al, U.S. Pat. No. 3,790,977; France Pat. No. 1,388,190, Dec. 28, 1964; Alter, U.S. Pat. No. 4,021,874; Simpson, U.S. Pat. No. 3,665,532; Fournillier, U.S. Pat. No. 3,191,200; Howland, U.S. Pat. No. 2,389,729; Parker, U.S. Pat. No. 2,531,946; Thompson, U.S. Pat. No. 3,585,664; Ellis, U.S. Pat. No. 3,514,798; and West German Pat. No. 2,315,057, Oct. 11, 1973; as exemplary.

It is known in the construction of water vessels, skiis and the like, to provide relatively flat portions of top and bottom sections, formed of polymeric material, often reenforced with glass fiber, these flat sections being bonded together to form a bonded flange lip. Such constructions are shown in the Christensen U.S. Pat. No. 3,553,750, see FIG. 3; in modified form in Halfon, U.S. Pat. No. 3,956,785, see FIG. 5; Love, U.S. Pat. No. 2,998,798, including additional clips, see FIG. 14; Krupnik, U.S. Pat. No. 3,143,357; Greig et al, U.S. Pat. No. 3,383,720, see FIG. 6; Sawchuk, U.S. Pat. No. 3,213,822, see FIG. 3; and in various forms in the above-identified patents to Bombardier et al, Alter et al, Howland, U.S. Pat. No. 2,389,729 which describes a surfboard; Parker, U.S. Pat. No. 2,531,946, also related to a surfboard; Thompson, U.S. Pat. No. 3,585,664, disclosing a water ski; Ellis, U.S. Pat. No. 3,514,798, surfboard, as well as the German Pat. No. 2,315,057. In every instance, of which I am aware, the flange formed by sealing upper and lower shell portions is designed to rest substantially above the water line and is not co-extensive with the planing surface. In the German Pat. No. 2,315,057, the lip, in the very rearmost section, approaches a lower flat portion of a surface but the planing occurs on specially configured extensions which project downwardly from the surface into the water and constitute the planing surfaces.

DISCLOSURE OF THE INVENTION

I have discovered that there are significant and unexpected advantages in terms of strength, durability, speed and handleability of planing boards, especially planing boards for use in water, e.g. surfboards, knee boards, water skiis and the like, in which the bottom is comprised of a sheet of polymeric resin, which may optionally include glass fiber reenforcing, the bottom sheet longitudinally comprising an elongate generally flat portion with an upwardly curving front portion the entire bottom sheet being continuous and substantially flat in the lateral direction along the length thereof; and a top comprised of a sheet of polymeric resin, optionally including glass fiber reenforcing, the top sheet comprising a flat peripheral lip portion longitudinally curved to correspond to the bottom curvature, a raised portion extending around a major portion of the inside of the lip portion and a central portion which rests against the central portion of the bottom, the lip portions of the top and bottom being adhesively bonded to form a flat joining flange extending laterally outwardly around the periphery of the planing board, the bottom of the flange being co-planar laterally with the bottom of the planing board. Another feature of the invention is the provision of means designing an aperture adjacent to and on the upper side of the bottom sheet, communicating between the volume defined by the raised portion of the top sheet and the exterior of the board, and means forming another aperture in the raised portion of the top sheet, these portions being subject to being sealed by the insertion of wax to permit admission of water into and the expulsion of water from the volume defined by the raised portion of a top.

BEST MODE FOR CARRYING OUT THE INVENTION

Figure 1:
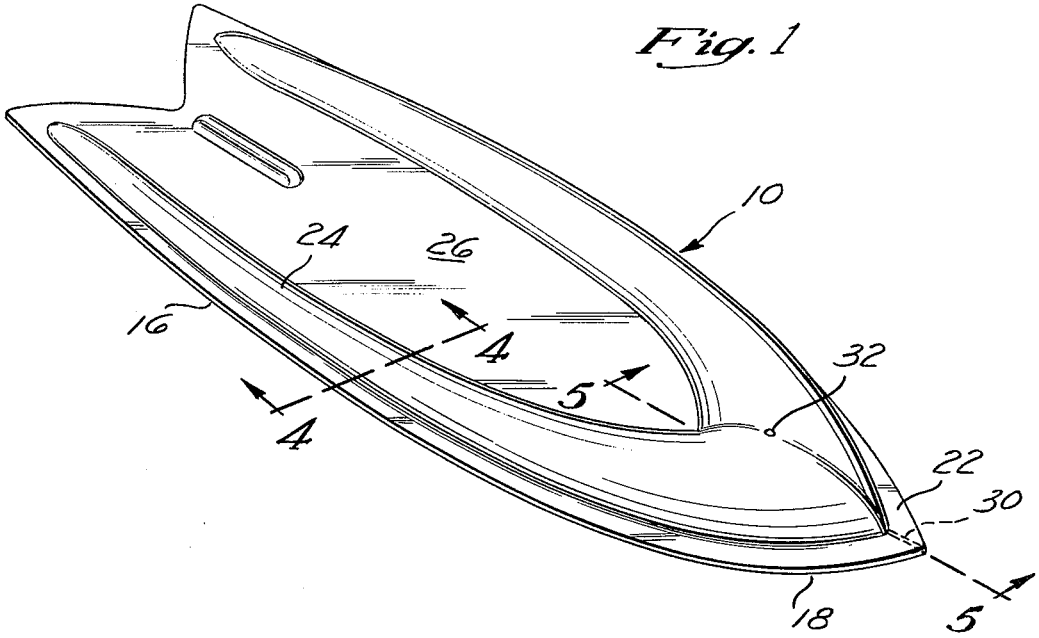
FIG. 1 is a perspective view of the top of the planing board, a surfboard or knee board, for example, of this invention.

The planing board, which in the exemplary embodiment is a surfboard, typically a small size surfboard often called a knee board, shown at 10 in FIG. 1.

Figure 3:
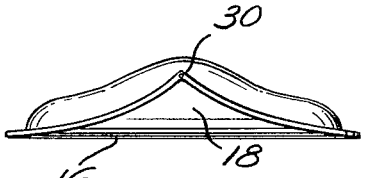
FIG. 3 is a view looking toward the front of the planing board of this invention.
Figure 4:
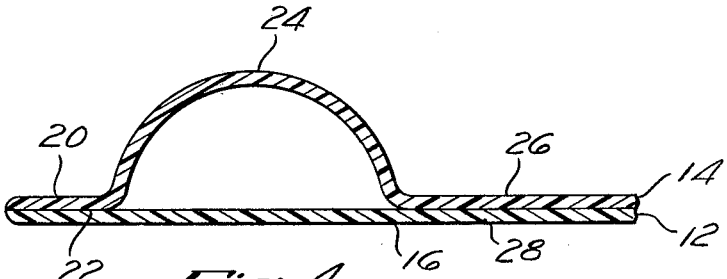
FIG. 4 is a partial view shown in cross-section of the volume defined by the raised portion of the top sheet of the planing board, taken substantially along lines 4—4 in the direction of the arrows, as shown in FIG. 1.
Figure 5:
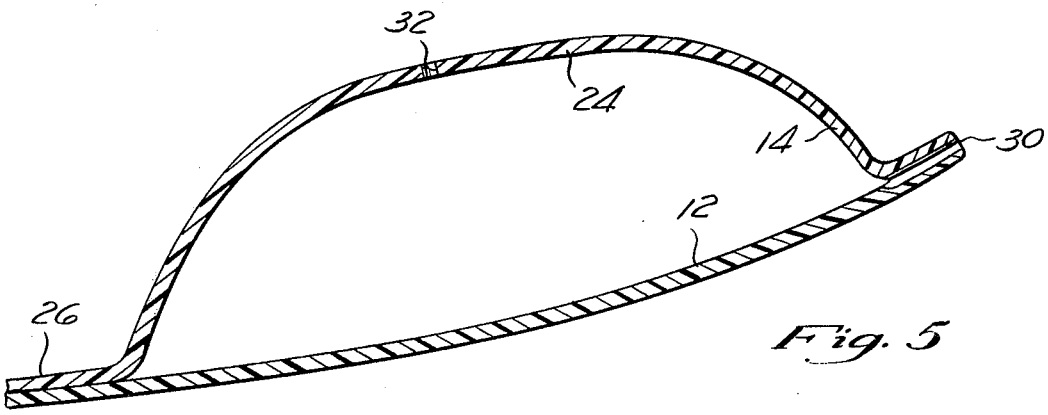
FIG. 5 is a partial side view in cross-section showing the construction of the front portion of the planing board of this invention, and taken substantially along lines 5—5 in the direction of the arrows, as shown in FIG. 1.

The planing board 10 is made up of a lower sheet 12 and an upper sheet 14, the relationship of which is best shown in FIGS. 4 and 5. In overall configuration, the bottom comprises a sheet of polymeric resin, which optionally includes glass fiber reenforcing, the bottom sheet longitudinally comprising an elongate generally flat portion 16 and an upwardly curving front portion 18, best shown in FIG, 2, the entire sheet being continuous and substantially flat in the lateral direction along substantially the entire length thereof, as best shown in FIG. 3.

Figure 2:
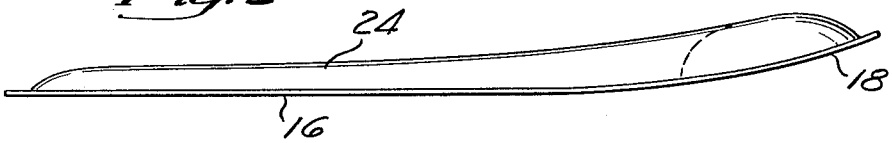
FIG. 2 is a side view of the planing board of this invention.

The top 14 comprises a sheet of polymeric resin, which optionally may include glass fiber reenforcing and typically is of the same composition as the bottom sheet, the top sheet comprising three portions. The first of the three portions comprises a lateral substantially flat peripheral lip portion 20 having substantially the same outline configuration as the outline configuration of the bottom sheet, and being curved longitudinally, as depicted in FIG. 2, for example, to the longitudinal curvature of the bottom such that the lip 20 lays snugly against the periphery of the bottom, the periphery of the bottom and the lip 20 laterally forming a co-mating joint 22 extending laterally inwardly from the periphery and substantially flat configuration. The second portion of the top comprises a raised portion 24 extending around the top adjacent and inside of a majority of the peripheral lip portion 20, defining a volume which provides a buoyancy for the board. The third portion of the top is a generally centrally disposed, laterally substantially flat portion 26 which is curved longitudinally in correspondence to the longitudinal curvature of the bottom sheet to lay snugly against the bottom sheet, the relative positions of the central portion 26 of the top and the central portion 28 of the bottom being best shown in FIG. 4. The top and the bottom are bonded together along the peripheral lip joint to thereby form an enclosed volume defined by the configuration of the raised portion 24 of the top. The peripheral lip portions of the top and the bottom adhesively bonded together form a flat flange 22 which extends laterally outwardly around the periphery of the planing board, the bottom of the flange 22 being co-planar laterally with the bottom of the planing board. In a preferred embodiment, but not necessary to the practice of the invention, the central portions 26 and 28 are also adhesively bonded.

Also in the preferred embodiment, the planing board comprises means defining an aperture 30 which is adjacent to and on the upper side of the bottom sheet 12 and communicates between the volume defined by the raised portion 24 of the top sheet and the exterior of the board, and means forming another aperture 32 in the raised portion of the top sheet 24.

The top and bottom sheets may be the same or different compositions. Most commonly, it is convenient to make them of the same composition but this is not essential. These sheets, either or both of them, may be composed of glass fiber reenforced thermosetting resins, such as the epoxy and polyester resins conventionally used in glass fiber reenforced resin structures, as in the boat industry, for example. These sheets may also be formed of ABS (acrylonitrilebutadiene-styrene) resins, or, from that matter, any polymeric resin which is produced in the desired configuration or which is thermally formed or otherwise formed in the desired configuration. These resins and reenforcings are well known in the boat and other structural fabrication arts and, vis-a-vis the compositions per se constitute no part of this invention. Conventional bonding agents may also be used. Epoxy bonding agents are most conventionally used because of the fast, extremely high strength bonds formed. Acrylamide and polyester resins, among others, may also be used if desired. In addition, many of the resins compositions of which the sheets 12 and 14 may be formed may be firmly bonded simply by the application of heat at the joint, or may be solvent bonded simply by applying a layer of solvent in the bond area and dissolving a small portion of the resin of which the sheets are composed. Resin bonding techniques are commonly used in the boating industry and are applicable here.

The apertures 30 and 32 are, in use, typically filled with wax to seal them. Before filling these apertures with wax, a desired amount of water may be admitted into the volume defined by the raised portion 24 to give any desired buoyancy to the planing board. If the buoyancy is desired to be changed, or the water is to be removed during periods of nonuse, the aperture areas of 30 and 32 are simply warmed to melt the wax or the wax is forced out with any sharp objects, e.g. a nail, pen or the like, and the water is allowed to drain or, if desired, air pressure may be introduced at apertures 32 to pump or force the water out aperture 30.

It has been found from actual tests that the planing board of this invention in the form of a knee board is much faster than knee boards of conventional construction in which the lateral side walls of the planing surface are curved upwardly. In the prior art, the water tends to ride up on the sides and increases the friction during movement. In the present invention, the friction is reduced and the board planes on a virtually flat surface laterally, giving far less resistance to movement through the water.

The planing board of this invention has been tested in surf where it is faster than the prior art boards and more easily controlled. It has also been tested as a towable ski planing board, to be towed behind a power boat or power ski. Since the friction is greatly reduced as compared with other boards, less power is required to propel the board.

Industrial Application

The planing boards of this invention find application as recreational boards in water and snow sports generally.

What is claimed is:

1. A planing board comprising the coacting combination of:

a bottom comprised of a sheet of polymeric resin, optionally including glass fiber reenforcing, the sheet longitudinally comprising an elongate generally flat portion and an upwardly curving front portion, the entire sheet being continuous and substantially flat in the lateral direction along substantially the entire length thereof;

a top comprised of a sheet of polymeric resin, optionally including glass fiber reenforcing, the sheet comprising three portions, the first portion comprising a laterally substantially flat peripheral lip portion having substantially the same outline configuration as the outline configuration of the bottom, and being curved longitudinally corresponding to the longitudinal curvature of the bottom such that the lip lays snugly against the periphery of the bottom, the periphery of the bottom and the lip laterally forming a co-mating joint extending laterally inwardly in a substantially flat configuration, the second portion of the top comprising a raised portion extending around the top adjacent and inside a majority of the peripheral lip portion, the third portion being a generally central laterally substantially flat portion curved longitudinally in correspondence to the longitudinal curve of the bottom to lay snugly against the bottom; and the peripheral lip portions of the top and bottom adhesively bonded together forming a flat joining flange extending laterally outwardly around the periphery of the planing board, the bottom of the flange being co-planar laterally with the bottom of the planing board.

2. The planing board of claim 1 wherein central portions of the top and bottom sheets are bonded together.

3. The planing board of claim 2 further comprising means defining an aperture adjacent to the upper side of the bottom sheet communicating between the volume defined by the raised portion of the top sheet and the exterior of the board, and means forming another aperture in the raised portion of the top sheet.

4. The planing board of claim 1 further comprising means defining an aperture adjacent to the upper side of the bottom sheet communicating between the volume defined by the raised portion of the top sheet and the exterior of the board, and means forming another aperture in the raised portion of the top sheet.

* * * * *